United States Patent [19]

Schaft

[11] Patent Number: 4,733,136

[45] Date of Patent: Mar. 22, 1988

[54] METHOD OF REGULATING THE POWER OF VAPOR DISCHARGE LAMPS

[76] Inventor: Volker Schaft, Barkenkoppel 38, 2000 Hamburg 65, Fed. Rep. of Germany

[21] Appl. No.: 810,554

[22] Filed: Dec. 18, 1985

[30] Foreign Application Priority Data

Feb. 15, 1985 [DE] Fed. Rep. of Germany ..... 3505182

[51] Int. Cl.[4] ..... H05B 41/16; H05B 41/392

[52] U.S. Cl. ..... 315/291; 315/293; 315/299; 315/301; 315/307; 315/308; 315/DIG. 4; 315/DIG. 7; 315/289; 315/194; 315/137; 315/144

[58] Field of Search ..... 315/291, 293, 299, 301, 315/307, 308, DIG. 4, DIG. 7, DIG. 5, 289, 283, 194, 137, 144

[56] References Cited

U.S. PATENT DOCUMENTS

| | | | |
|---|---|---|---|
| 3,989,976 | 11/1976 | Tabor | 315/258 |
| 3,991,344 | 11/1976 | Tabor | 315/258 |
| 4,146,819 | 3/1979 | Hunter | 315/307 |
| 4,507,569 | 3/1985 | Hess, II | 315/291 |

*Primary Examiner*—David K. Moore
*Assistant Examiner*—Michael J. Nickerson
*Attorney, Agent, or Firm*—Becker & Becker, Inc.

[57] ABSTRACT

During operation of ionized vapor discharge lamps and the partial load range, the lamp current is reduced from the rated value, the drop in voltage is measured during and after the reduction of the lamp current, and when the period of constant voltage that follows the drop in voltage is reached, the lamp current is increased accompanied by simultaneous determination of the increase in voltage. The lamp current is thereupon controlled in such a way that during the partial load range operation of the lamp, the voltage value is slightly greater than that of the voltage of the period of constant voltage.

4 Claims, 2 Drawing Figures

METHOD OF REGULATING THE POWER OF VAPOR DISCHARGE LAMPS

BACKGROUND OF THE INVENTION

1. Field of the Invention

The present invention relates to a method of regulating the luminous flux or current of ionized or turned-on vapor discharge lamps, especially metallic vapor lamps, such as mercury vapor lamps.

2. Description of the Prior Art

Mercury vapor lamps serve not only as sources of light for illuminating industrial plants, streets, and/or athletic stadiums or arenas (via floodlights), but are also used for technological processes as ultraviolet emitters. Thus, for example, in the printing industry, ultraviolet-reactive inks and lacquers are being utilized more and more frequently. These inks and lacquers dry very rapidly when exposed to ultraviolet light, and in addition permit handling of the surface quality (for example, by imprinting low quality paper or cardboard with ultraviolet lacquers, the impression of high quality special material can be produced). When the necessary ultraviolet irradiation equipment is set up, the assumption is made that the imprint material will pass continuously through the ultraviolet drying stage. However, as a rule, the imprint material in fact does not pass continuously through, so that where the drier takes a large amount of power, about 10 kW up to more than 100 kW of energy could be saved if the radiation sources were shut off or at least cut way back during interruptions in the passage of imprint material. In addition, reducing the power during these interruptions increases the life expectancy of the ultraviolet radiation sources.

Like all other vapor discharge lamps, mercury vapor lamps have the drawback that after they have been shut off, they must cool off to such an extent that all of the metallic vapor has been condensed. In addition, when the lamps are turned back on, an ionizing process takes place during which the condensed metal vaporizes; this takes several minutes. Due to the considerable lag time, this manner of regulating the power is not suitable. When radiation sources of this type are operated far below the nominal or rated load region, there exists the danger that as a result of the radiation source being cooled off to too great a degree, the arc discharge that generates the radiation will collapse, which has the same consequence as if the radiation source were actually shut off.

An object of the present invention therefore is to provide a method of regulating the operation of vapor discharge lamps, and hence for regulating the luminous flux or lamp current emitted by these lamps, with the inventive method at all times assuring that the radiation source can be operated below the rated load region, and can also be switched, without time delay, from a partial load range to a full load range.

Brief Description of the Drawings

This object, and other objects and advantages of the present invention, will appear more clearly from the following specification in conjunction with the accompanying schematic drawings

Summary of the Invention

Pursuant to one embodiment for practicing the inventive method, the lamp current is first reduced from the nominal or rated value to a value which is preferably not less than 15% of the rated current. During and after this decrease of the lamp current, the drop in voltage is measured. When the period of constant voltage that follows this drop in voltage is reached, the lamp current is increased to the rated value accompanied by the simultaneous determination of the increase in voltage. Subsequently, when the rated voltage has been reached, the lamp current is again decreased.

What is accomplished with the method of the present invention is that immediately upon commencement of the condensation of the vaporized charge carrier as a result of the cooling off of the slightly charged lamp, the latter is again heated up prior to collapse of the arc discharge. In this way, the current taken up by the lamp changes without a time delay, i.e. without a lag, due to the fact that the arc discharge continues to exist.

Pursuant to another embodiment for carrying out the method of the present invention, when the period of constant voltage that follows the drop in voltage is reached, the lamp current, rather than being increased to the rated value, is only increased to such an extent and for such a length until the voltage has risen to a predetermined value, with this value being between the rated voltage and the value of the voltage during the period of constant voltage. Thereupon, the lamp current is controlled in such a way that during the partial load range of the lamp, the predetermined voltage value is maintained.

Description of Preferred Embodiments

Figure 1:
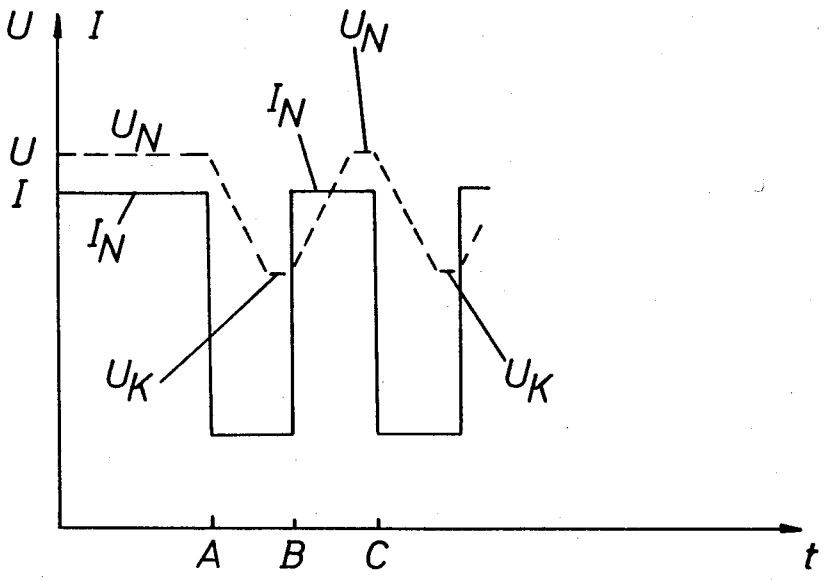
FIG. 1 and FIG. 2 are view showing graphs in which the lamp voltage and the lamp current are plotted as a function of time.
Figure 2:
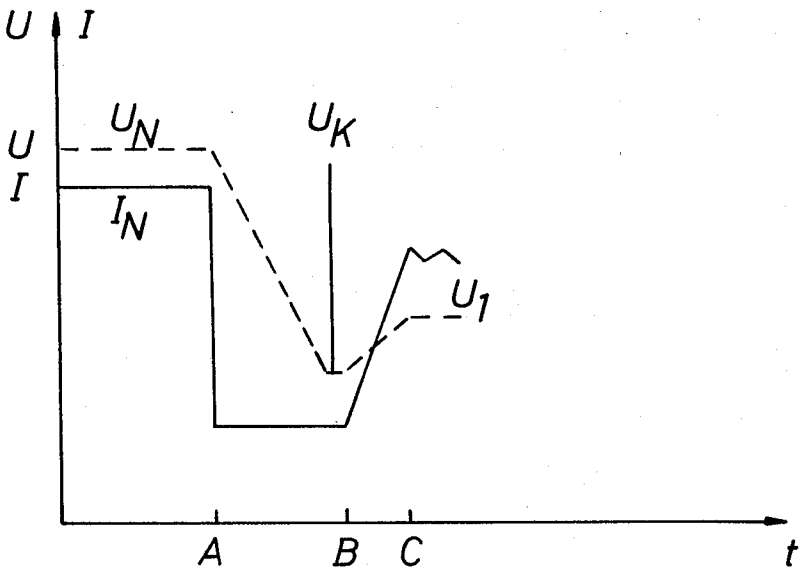

Referring now to the drawings in detail, during the operation of a vapor discharge lamp, such as a mercury vapor lamp, the maximum charging rate or current consumption of which is limited by a conventional power supply unit, the current $I_N$ and the voltag $U_N$ are essentially constant values in the rated or normal range of use. If, in order to reduce the luminous flux given off by the lamp, the current I that is to be supplied to the lamp is reduced at the time point A (as shown in FIG. 1), which can be effected abruptly, the voltage U applied to the lamp poles is also reduced, though more gradually. During this process, the lamp cools off, so that the vapors of the metallic charge carrier, for example mercury, begin to condense as the point of condensation is reached. As condensation of the metallic vapor begins, the voltage U ceases to change as long as metallic vapors are still present in the lamp housing, and the arc discharge of the lamp is maintained. At the start of this period of constant voltage $U_K$, at the time point B, the lamp current I is again abruptly increased to the rated value. Since at this point of time the arc discharge of the lamp has not yet collapsed, not only does the lamp immediately take the current, but the voltage U also again increases to the normal value $U_N$ as the temperature of the lamp increases. If desired, at this time point C a renewed regulating cycle can be initiated by reducing the lamp current I. In the regulating procedure diagrammatically represented in the graph of FIG. 2 for the partial load operation of vapor discharge lamps, with the commencement of the partial load operation at the time point A by reduction of the lamp current I, after the point of condensation is reached, i.e. the period of constant voltage $U_K$ (time point B), the lamp current I is increased to only such an extent and for only such a length of time until the voltage has risen to a value $U_1$. Thereupon (time point C), by controlling the change of the lamp current I during the duration of the partial load operation, the voltage is maintained at the value $U_1$.

The present invention is, of course, in no way restricted to the specific disclosure of the specification and drawings, but also encompasses any modifications within the scope of the appended claims.

What I claim is:

1. A method of regulating current of turnedon vapor discharge lamps having an arc discharge that continues to exist as a vaporized charge carrier in a slightly charged lamp and that is operated under reduced power capacity although at anytime being capable without a time delay lag to be switched to any desired operating point from a partial load range to a rated full load range as a radiation source of luminous flux, said method including the steps of:

reducing the lamp current;

measuring the drop in voltage during and after said reducing of lamp current;

determining a time period of constant voltage that follows said drop in voltage caused by commencement of condensation of the vaporized charge carrier as a result of cooling off of the slightly charged lamp;

increasing said lamp current when said time period of constant voltage is reached so that said lamp is heated up prior to collapse of the arc discharge;

measuring the increase in voltage during and after said increasing of said lamp current; and reducing said lamp current when a predetermined voltage is reached.

2. A method according to claim 1, in which said increasing step comprises increasing said lamp current to the rated value; and in which said lastmentioned reduceing step comprises reducing said lamp current when the rated voltage is reached.

3. A method according to claim 1, in which said last-mentioned reducing step comprises reducing said lamp current when a voltage is reached that has a value between the rated voltage and the voltage of the period of constant voltage; and which includes the additional step of increasing said lamp current when the voltage falls below said intermediate-value voltage.

4. A method according to claim 1, in which said steps of reducing said lamp current comprise reducing said lamp current to at most 15% of the rated current value.

* * * * *

UNITED STATES PATENT AND TRADEMARK OFFICE

CERTIFICATE OF CORRECTION

PATENT NO. : 4,733,136

DATED : Mar. 22, 1988

INVENTOR(S) : Volker Schaft

It is certified that error appears in the above-identified patent and that said Letters Patent is hereby corrected as shown below:

On the Title-Abstract page insert the following:

[30] Foreign Application Priority Data

Dec. 18, 1984 [DE] Fed. Rep. of Germany....3446083

Signed and Sealed this

Sixteenth Day of August, 1988

*Attest:*

DONALD J. QUIGG

*Attesting Officer*

*Commissioner of Patents and Trademarks*